US006182292B1

(12) United States Patent
Knoll

(10) Patent No.: US 6,182,292 B1
(45) Date of Patent: Feb. 6, 2001

(54) SHIRT WITH NECKTIE RETAINER

(76) Inventor: Wayne Knoll, 409 Brewster Ave., Silver Spring, MD (US) 20901

( * ) Notice: Under 35 U.S.C. 154(b), the term of this patent shall be extended for 0 days.

(21) Appl. No.: 09/360,145

(22) Filed: Jul. 26, 1999

(51) Int. Cl.[7] ..... A41B 1/00; A41D 25/10
(52) U.S. Cl. ..... 2/115; 2/145
(58) Field of Search ..... 2/144, 145, 103, 2/137, 156; 24/9, 3.1, 3.4, 49.1, 56, 64, 66.4, 66.1

(56) References Cited

U.S. PATENT DOCUMENTS

| | | | | |
|---|---|---|---|---|
| 2,624,050 | * | 1/1953 | Boller | 2/115 |
| 2,652,568 | * | 9/1953 | Bagier | 2/145 |
| 2,652,569 | * | 9/1953 | Confino | 2/145 |
| 2,743,452 | * | 5/1956 | Waterbury | 2/145 |
| 2,746,055 | * | 5/1956 | Gleason | 2/145 |
| 2,749,553 | * | 6/1956 | Miller | 2/145 |
| 2,813,273 | * | 11/1957 | Schreter | 2/145 |
| 4,827,576 | * | 5/1989 | Prince, Jr. | 24/49 CF |
| 4,920,579 | * | 5/1990 | Swain | 2/145 |
| 4,933,991 | * | 6/1990 | Love | 2/115 |
| 5,095,546 | * | 3/1992 | Jones | 2/145 |
| 5,315,713 | * | 5/1994 | Pileggi | 2/145 |
| 5,337,457 | * | 8/1994 | Chennault | 24/49 R |
| 5,353,438 | * | 10/1994 | Voiles | 2/145 |
| 5,815,836 | * | 10/1998 | Jacobson, II | 2/145 |

* cited by examiner

*Primary Examiner*—Gloria M. Hale
*Assistant Examiner*—Alissa L. Hoey
(74) *Attorney, Agent, or Firm*—Jones, Tullar & Cooper PC

(57) ABSTRACT

The present invention relates to a shirt with an incorporated necktie retainer. The cloth retainer is used to anchor two hanging termini of a necktie, so the ends don't encumber the wearer. The vertically directed retainer has a place for two button holes that slip onto the shirt buttons after passing through the longitudinal name tag on the back of the wider hanging portion of a necktie. The retainer has the same resemblance to the shirt in color, texture, material, design etc. because it is just the lower continuation of the button front. Namely the side with the holes where the bottom goes through, at the lowest portion of the shirt. The retainer extends two hole lengths below the end of the shirt front. There is an appropriate type of stitching that allows the retainer to be cut off and apart from the shirt without any loose frayed ends.

10 Claims, 2 Drawing Sheets

FIG. 1
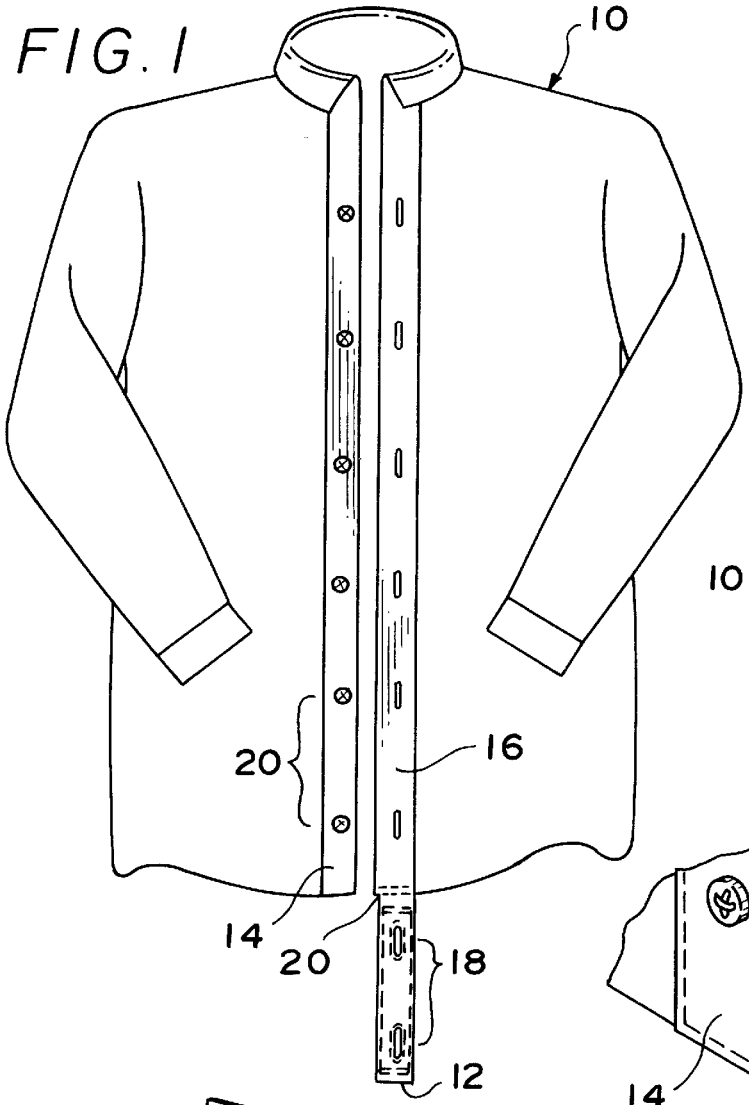
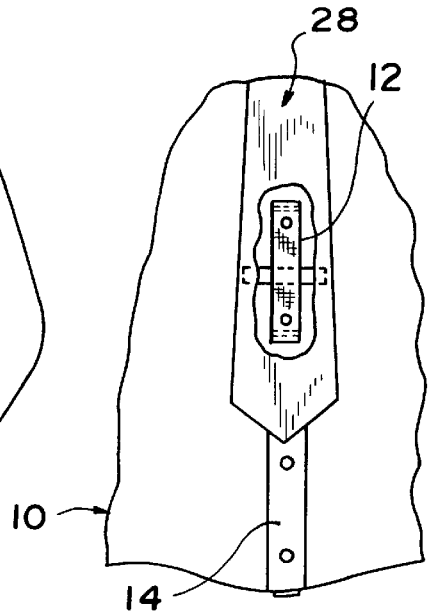
FIG. 4
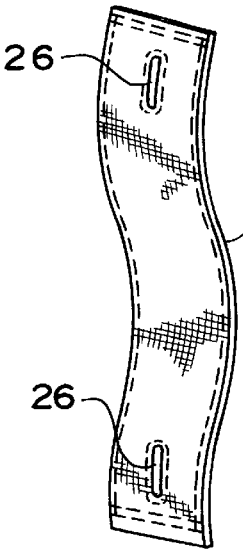
FIG. 3
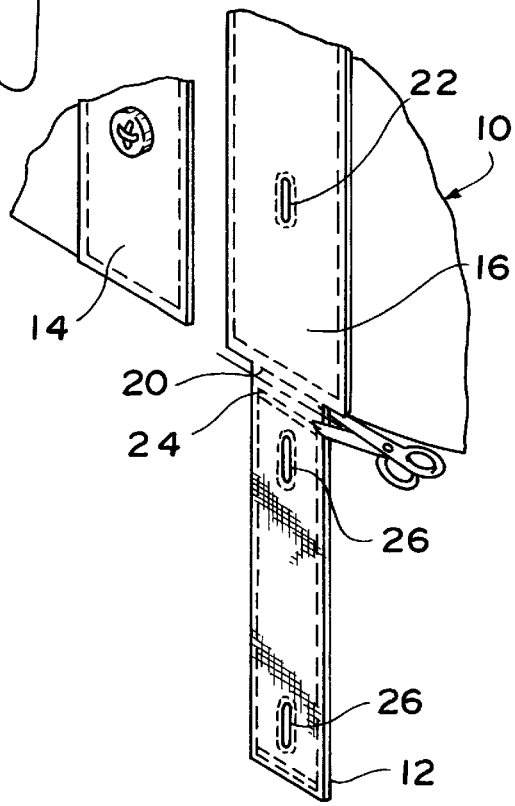
FIG. 2

SHIRT WITH NECKTIE RETAINER

FIELD OF THE INVENTION

The present invention relates to a shirt and more particularly to a necktie retainer that is manufactured with a shirt for use precisely and exactly but not inclusively for the manufactured shirt in conjunction with a necktie.

BACKGROUND OF THE INVENTION

Men and on occasion, women around the world wear neckties. The tie looks and functions best when kept in a frontal line. This straight close to the body position is hard to maintain with the daily real world use. Wind, eating, food, normal twisting and turning conspire to cause staining and damage as well as displacing the aesthetic view of the tie. Necktie retainers have been developed and employed over many decades to hold fast the tie through various methods. Pins are probably the oldest form yet cause damage with each insertion. Tie bars are prolific yet wrinkle and crunch ties, especially of finer origin. Because of their deficiencies, necktie retainers are not popular. Previous patents that have attempted non-penetrating retainers are Roop (U.S. Pat. No. 2,588,576), Confino (U.S. Pat. No. 2,652,569), (U.S. Pat. No. 3,405,408) and Hagan (U.S. Pat. No. 3,487,471).

Some use a hook and loop type retainer. A button hole retainer with ovoid holes for various spaced buttons by Begg (U.S. Pat. No. 4,972,523) is not made of the same material as the shirt and more importantly is not made as a part of the shirt. This retainer must be acquired separately and since the holes do not exactly fit any shirt buttons there is room for slippage. The retainer slipping off a short button would cause the necktie to swing freely, mostly at an inopportune time. Abdallah (U.S. Pat. No. 5,109,547) uses a two piece plastic design that can be incorporated into a necktie causing another manufacturing process. It is also complicated by it's need to be somehow fastened to the tie either with a hook and loop type fastener or taping methods. Caniglia (U.S. Pat. No. 5,571,218) has patented a shirt with a permanent strap that is a modification of a shirt, that is visible as it is worn over the entire tie in the chest area. The necktie retainer of Compelia et al (U.S. Pat. No. 5,245,708) consists of a pliable thin rectangle material with two holes that button onto the shirt after passing through the neck apparel's transverse member. This restrains the necktie while allowing some vertical movement. This method is good but has the deficiency and short coming of being designed, manufactured, distributed, packaged and sold as a separate device. And more importantly intended as a separate adjunct device. This invention provides a novel shirt conjoined with it's own retainer that matches it in texture, color, pattern, design. The retainer is worn through a necktie backing thence affixing it to a shirt

SUMMARY OF THE INVENTION

Separate marketing is needed to arouse awareness of the retainer, and the customer must then locate which store has these soft pliable retainers (they are rare where he must purchase separately from its intended shirt). He now also has the added task of matching up shirt fabric, color, texture, design, button hole length to the purchased soft pliable retainer, maybe causing an unwanted mismatch. There is no way that an exact match can be made unless done at manufacture. Therefore what is needed is a retainer as mentioned that is manufactured concurrently with the shirt of its intended use. This has the added advantage to the purchaser (not previously afforded) of singularity of construction, purchase consolidation, affordability (since made, marketed, inventoried and sold together) another major advantage is the novelty offered a shirt manufacturer that no other shirt has a convenience like this one. It could also be marketed as such.

This shirt is made such that the lowest bottom front area extends longer them usual so this end can be simultaneously manufactured with a necktie retainer on the shirt. This extension would be cut or clipped free to be used as a retainer. Nearly all neckties have a manufacturers label sewn onto the wider inner portion of the necktie, whereby the narrower necktie end can slip into.

This retainer is vertically and parallel positioned on the shirt button front with one hole buttoned to the shirt superiorly to the transverse member label and the middle portion passing through the necktie name tag then the distal end is buttoned to the nearest shirt button inferiorly to the tie's name tag, securing the necktie to the shirt The rectangular retainer has a set length between button holes that is approximately 5 millimeters longer than the shirt button holes.

This extra distance allows the retainer to pass through the tie's name tag transverse member. This retainer as worn restricts movement of the necktie, saving the wearer from all the difficulties caused by wind, bending, eating, etc.

This shirt can be of any design or pattern. The preferred embodiment is one such that men traditionally wear tie's with, having a linear row of evenly spaced buttons down the front with the buttons only on one side and the other side having a row of corresponding button holes. The button hole edge of the shirt is manufactured by traditional techniques that entail folding over of the shirt fabric such that it forms a firmer trim to hold the button. This folding would continue to extend beyond the length of the shirt end. This extension forms the retainer. It's length would vary but would be whatever is the distance of two button holes with an extra 5 mm interspaced between the holes. Otherwise the width of the retainer equals the shirt button side edge. Double-double stitching separates the last transverse stitch of the shirt (as would normally be made) and the first transverse stitch of the retainer. One would cut between the two double stitches. This has the advantage that once the retainer is cut free, the ends of the shirt and retainer won't fray because of the tight double stitching present will keep the ends tight and neat.

BRIEF DESCRIPTION OF DRAWINGS

Five figures have been selected to illustrate a preferred embodiment of the present invention.

FIG. 1 is a frontal view of a shirt after manufacturer but before severance of the retainer;

FIG. 2 is a partial view of the shirt showing the inbred design of the retainer, its location and cut points;

FIG. 3 is a view of the retainer;

FIG. 4 shows a frontal partial view of detached retainer holding a tie to the shirt holes.

DETAILED DESCRIPTION OF THE PREFERRED EMBODIMENT

Figure 5:
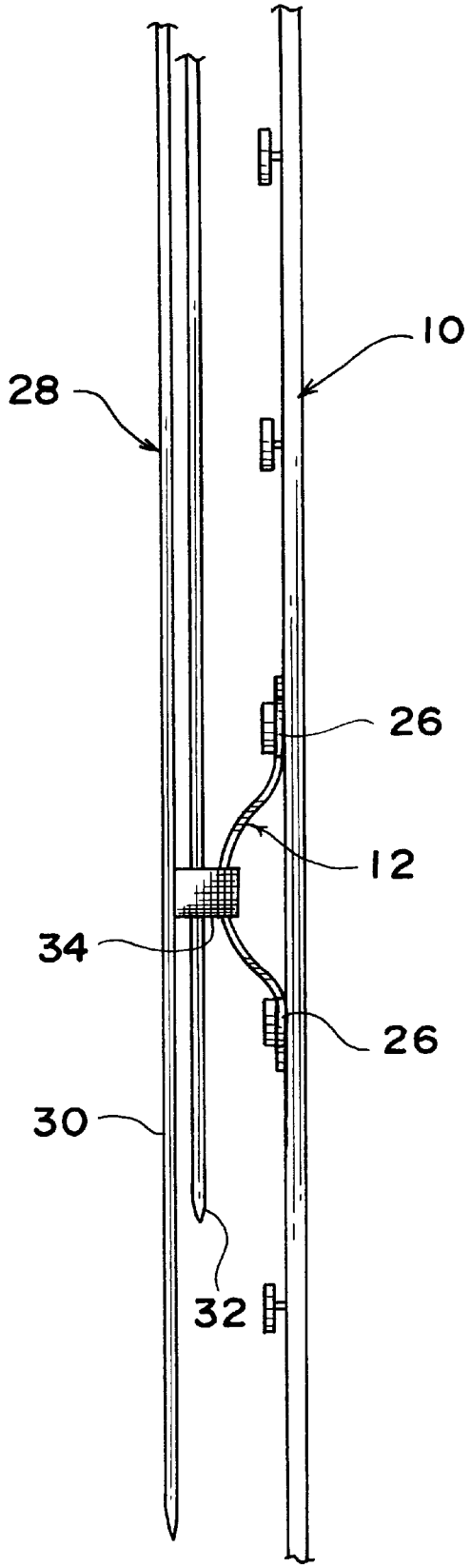
FIG. 5 is a partial side view showing the retainer in use with a tie.

A typical shirt 10 of this invention as shown in FIG. 1 is an ordinary men's or women's shirt with which a tie could be worn. It is normal in every manner with the only and important exception of having an extra length of cloth 12 on the button panel 14 or button hole panel 16 of the shirt edge, with FIG. 1 showing the connection to the button hole panel

16. The distance 18 between the button holes is equal to the distance 20 between two buttons plus a few mm The appendage or retainer 12 is equal in width to the folded button hole side of the shirt and forms a continuation thereof The edge area 22 is provided where scissors (or other cutting devices) are used to cut the retainer 12 free of the shirt 10. FIG. 2 shows an enlarged view demonstrating the closeness and orientation of the double stitching 24. This figure demonstrates the ease and simplicity of manufacture by it's inbred design and cutting capability. The orientation and proportionality of holes 26 with interspacing 18 substantially matches the spacing of the buttons. FIG. 3 shows the shirt cloth retainer-extension 12 after cutting. FIG. 4 shows the necktie 28 and retainer 12 as a solitary object. The retainer 12 is made exactly of the same material as the shirt. It is noted that the two ends of the retainer 12 are square in shape with 90 degree corners. This is to allow ease of cutting from the shirt and as a matter of convention of the normal front ends of a men's shirt. The retainer has at least two button holes 26 which, as noted above, substantially matches the spacing of the buttons.

FIG. 5 shows the retainer 12 used as a tie clasp. The tie 28 typically includes a front panel 30 a rear panel 32 and a name tag 34.

To use the retainer 12, it is first removed from either side 14 or 16, passed through the opening defined by the name tag 34 and connected to two adjacent buttons.

It should be understood, that the shirt 10 can be used and worn whether or not the retainer 12 is removed. It should also be understood that the retainer may be made at the same time that the shirt is made.

What is claimed is:

1. A shirt and necktie retainer combination, comprising:

a shirt, having a plurality of spaced apart buttons, and an elongated panel containing a plurality of openings equal to the plurality of buttons; and a necktie retainer connected to and detachable from said shirt, said necktie retainer having at least two spaced apart openings, the spacing of which substantially equals the spacing between adjacent buttons on said shirt, wherein said retainer is formed as an extension of said panel.

2. The shirt and necktie retainer combination as defined in claim 1, wherein said necktie retainer is connected to said shirt by stitching.

3. The shirt and necktie combination as defined in claim 1, wherein said necktie retainer is rectangular defining a long axis with said openings extending along said long axis of the rectangle.

4. The and necktie retainer combination as defined in claim 1, wherein said shirt is made of a certain material and said necktie retainer is made of the same material as said shirt.

5. The shirt and necktie retainer combination of claim 1, wherein said retainer is manufactured whole with the shirt.

6. A shirt and necktie retainer combination, comprising:

a shirt, having a plurality of spaced apart buttons; and a necktie retainer connected to and detachable from said shirt, said necktie retainer having at least two spaced apart openings, the spacing of which substantially equals the spacing between adjacent buttons on said shirt, wherein said shirt includes a pair of elongated panels, one of said panels containing a plurality of openings and the other of said panels containing an equal plurality of buttons, and wherein said necktie retainer is detachably connected as an extension to one of said panels.

7. The shirt and necktie retainer combination as defined in claim 6, wherein said necktie retainer is connected as an extension to one of said panels by stitching.

8. The shirt and necktie retainer combination as defined in claim 7, wherein said necktie retainer is detached from one of said panels by cutting.

9. The shirt and necktie retainer combination as defined in claim 7, wherein said necktie retainer defines a width, and wherein said width of said necktie retainer is equal to that of said one of said panels.

10. A shirt and necktie retainer combination, comprising:

a shirt, having a plurality of spaced apart buttons; and a necktie retainer connected to and detachable from said shirt, said necktie retainer having at least two spaced apart openings, the spacing of which substantially equals the spacing between adjacent buttons on said shirt, wherein said necktie retainer is detached from said shirt by cutting.

* * * * *